US006811128B1

(12) United States Patent
Wagner et al.

(10) Patent No.: US 6,811,128 B1
(45) Date of Patent: Nov. 2, 2004

(54) PRODUCT SUPPORT APPARATUS FOR RETAIL DISPLAYS

(76) Inventors: James E. Wagner, 17 Sycamore Dr., Reading, PA (US) 19606; Vanessa S. Wagner, 515 Brighton Ave., Reading, PA (US) 19606

( * ) Notice: Subject to any disclaimer, the term of this patent is extended or adjusted under 35 U.S.C. 154(b) by 24 days.

(21) Appl. No.: 10/409,927

(22) Filed: Apr. 9, 2003

(51) Int. Cl.[7] ..... A47F 5/08

(52) U.S. Cl. ..... 248/220.31; 211/57.1; 211/59.1

(58) Field of Search ..... 211/57.1, 59.1; 248/220.31, 220.41, 220.42, 220.43, 225.21, 222.51; D6/566; 40/642.01; D8/370

(56) References Cited

U.S. PATENT DOCUMENTS 4,013,252 A * 3/1977 Braverman ..... 248/220.41
4,863,131 A * 9/1989 Kinseley ..... 248/220.41
4,905,846 A * 3/1990 Calvert ..... 211/59.1
5,014,949 A * 5/1991 Niven ..... 248/220.41
5,259,220 A * 11/1993 Fredrickson ..... 70/14
5,499,723 A * 3/1996 Morrow ..... 211/59.1
5,531,417 A * 7/1996 Valiulis et al. ..... 248/303
5,626,243 A * 5/1997 Brozak, Jr. ..... 211/59.1

OTHER PUBLICATIONS

Trion Industries Product Catalog, pp. 17–27, available online at http://www.triononline.com/catalog.php?catid=9.

* cited by examiner

*Primary Examiner*—Anita King
*Assistant Examiner*—Jon Szumny
(74) *Attorney, Agent, or Firm*—Miller Law Group, PLLC

(57) ABSTRACT

A product display bracket on which product packages, particularly blister pack packages, can be mounted is formed with a head portion that is configured to present a dimension which is larger than the conventional opening on a blister pack product package. The head portion restricts movement of the product packages off the product display bracket in a manner that only one product package can be removed at a time. The enlarged head portion will also restrict movement of the product packages off the support member when the support member is angled downwardly to facilitate the automatic movement of the product packages toward the head portion when the front product package is removed from the support member. Preferably, the head portion is formed as a triangularly shaped member with the hypotenuse oriented perpendicularly to the flow of product packages off the support member.

18 Claims, 3 Drawing Sheets

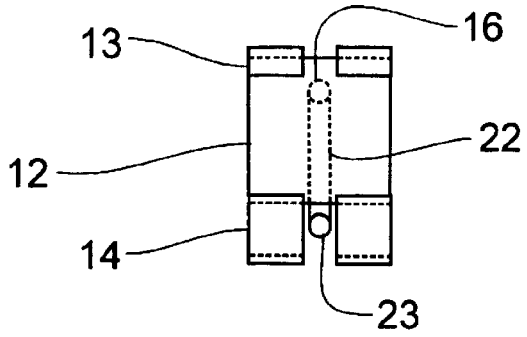
Fig. 4
Fig. 5
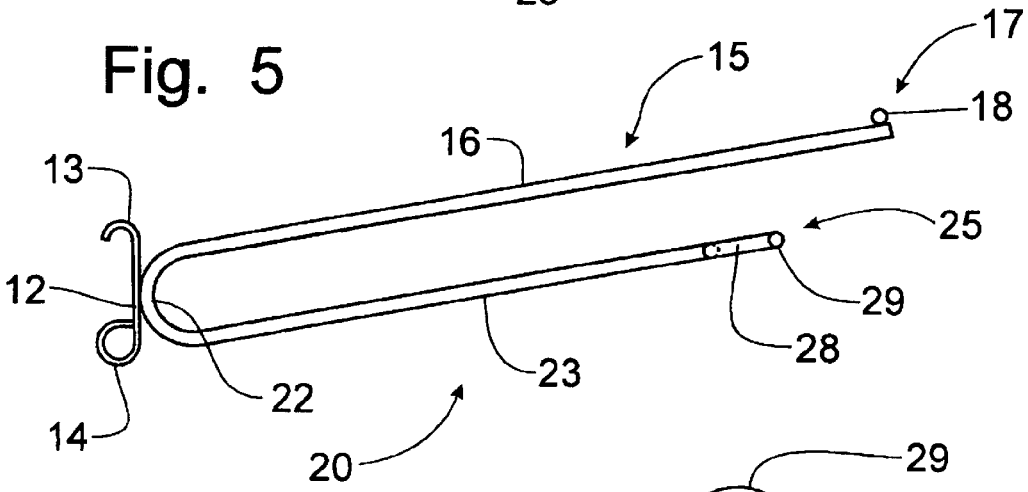
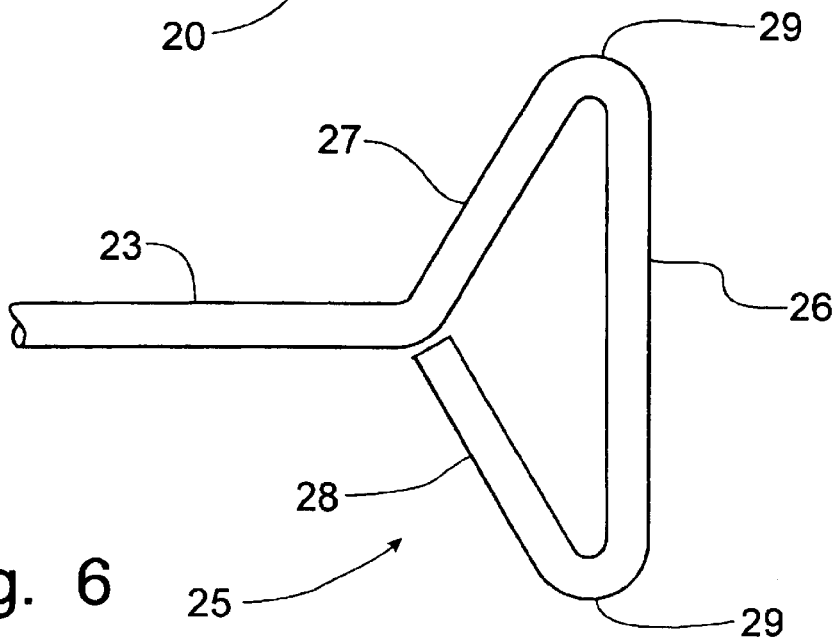
Fig. 6

PRODUCT SUPPORT APPARATUS FOR RETAIL DISPLAYS

BACKGROUND OF THE INVENTION

This invention relates to the display of product for retail sales and, more particularly, to a product display bracket for holding blister pack product packages in a sales display in a manner that the product cannot be pulled off of the product display bracket in multiples.

In retail stores, product is often presented for sale on boards from which product display brackets are mounted to hold groups of product in a linear manner extending outwardly from the board for easy access by the consumer/purchaser. These product display brackets are typically formed from wire and include a mounting member that engages the board for support of the product placed upon the wire product display bracket. The board is typically formed in one of several different configurations, including peg board in which holes are formed in the board for engagement by a wire mounting member; a slat wall formed with vertically spaced horizontal grooves for engagement with a specially shaped mounting member; and a wire grip in which vertically spaced horizontal wires are supported to be snapped into a formed mounting member.

Typically, these product support brackets are formed with a hook or loop at the end thereof to both hold the product on the support member and to protect the consumer for impacting the end of the support member. A plurality of product packages, often plastic-formed "blister pack" packages, having an opening at a top portion thereof, is slid onto the support member for display. When a customer desires to purchase one of the displayed products, the front package is grasped and removed off the end of the support member. Since the support member is horizontally oriented, the remaining product packages remain in their original position until manually brought forward to the end of the support member.

The product display support brackets come in many different configurations and formations. One supplier of such product support brackets is Trion. Referring to the Trion catalog, which contains approximately sixty pages of product display-related materials, the product display brackets are formed to permit the product packages to be easily removed and conveniently accessed by the consumer and are conducive to having the product packages removed in multiples, e.g. several product packages at once. In some instances, however, the retailer does not want the product packages to be easily removed in multiples because the product has a significant retail cost. The ability for a consumer to be able to quickly grasp several product packages at once does not restrict shoplifting activities adequately. For example, printer ink cartridges are often packaged in blister pack plastic packaging that are easily lifted from product display boards in multiples and transported out of the store without being paid for. Printer ink cartridges are sufficiently expensive that having a multiple group of them shoplifted from the retail store would constitute a substantial loss for the store. Often, the printer ink cartridges are placed in a restricted area in which only store personnel has access thereto, resulting in a higher labor cost in selling the product to the consumer.

Accordingly, it would be desirable for a product support bracket to restrict the removal of only one product package at a time from the support member. It would also be desirable for a product support bracket to facilitate the automatic movement of product packages to the front of the support member for presentation to the consumer without requiring the product packages to be manually moved forwardly on the support member.

SUMMARY OF THE INVENTION

It is an object of this invention to overcome the aforementioned disadvantages of the known prior art by providing a product support bracket that restricts movement of the product off the support member.

It is another object of this invention to provide a product support bracket that facilitates the displacement of product packages to the end of the support member when the front product package is removed from the support member.

It is a feature of this invention that the support member of a product support bracket is formed with a head portion that has a transverse dimension which is larger than the opening in the product package mounted on the support member.

It is another feature of this invention that the head portion of a product support member is operable to force the removal of the product package from the support member by moving the product package to the side of the support member.

It is an advantage of this invention that the product packages mounted on a product support bracket can only be removed from the support member one at a time.

It is another advantage of this invention that the risks associated with shoplifting of product packages mounted on a product support bracket is reduced.

It is still another advantage of this invention that the product support bracket can be oriented to feed product packages to the head portion whenever the front product package is removed from the support member.

It is still another feature of this invention that the head portion can be formed into a triangular shape in which the hypotenuse is oriented perpendicular to the linearly extending support member.

It is yet another feature of this invention that the length of the hypotenuse of the triangularly-shaped head portion is greater than the typical width of a slot formed in blister pack product packaging.

It is yet another advantage of this invention that the triangularly-shaped head portion stops product packaging from sliding off the support member when the support member is declined with respect to horizontal in order to feed product packages toward the head portion whenever the front product package is removed from the support member.

It is still another feature of this invention that the support member can be formed with an integral product information member.

It is a further feature of this invention that the mounting member can be formed in different configurations to permit the use of the product support member with a variety of display boards.

It is still another object of this invention to provide a product display bracket for use in retail stores that permits the removal of product packages only one at a time from the support member.

It is yet another object of this invention to provide a product display bracket that is durable in construction, inexpensive of manufacture, carefree of maintenance, facile in assemblage, and simple and effective in use.

These and other objects, features and advantages are accomplished according to the instant invention by providing a product display bracket on which product packages, particularly blister pack packages, can be mounted. The product display bracket is formed with a head portion that is configured to present a dimension which is larger than the conventional opening on a blister pack product package. The head portion restricts movement of the product packages off the product display bracket in a manner that only one product package can be removed at a time. The enlarged head portion will also restrict movement of the product packages off the support member when the support member is angled downwardly to facilitate the automatic movement of the product packages toward the head portion when the front product package is removed from the support member. Preferably, the head portion is formed as a triangularly shaped member with the hypotenuse oriented perpendicularly to the flow of product packages off the support member.

BRIEF DESCRIPTION OF THE DRAWINGS

The advantages of this invention will become apparent upon consideration of the following detailed disclosure of the invention, especially when taken in conjunction with the accompanying drawings wherein:

FIG. 4 is a rear elevational view of the mounting member for mounting the product display bracket on a display board as depicted in FIG. 1;

FIG. 5 is a side elevational view of a second embodiment of the product display bracket with the support member and product identification member inclined upwardly at approximately ten degrees relative to the horizontal configuration depicted in FIG. 1;

FIG. 6 is an enlarged plan view of the head portion of the support member depicted in FIG. 3;

DETAILED DESCRIPTION OF THE PREFERRED EMBODIMENT

Figure 1:
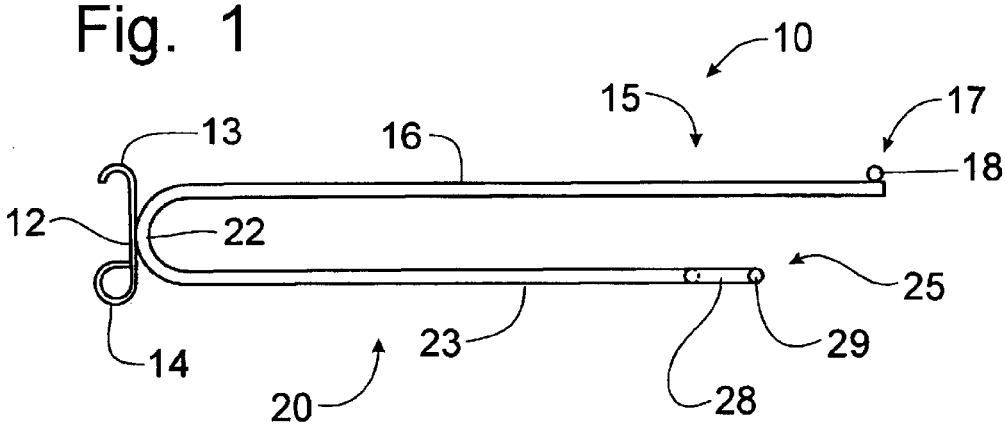
FIG. 1 is a side elevational view of a product display bracket incorporating the principles of the instant invention.

Referring to FIGS. 1-4, a first embodiment of a product display bracket incorporating the principles of the instant invention can best be seen. The product display bracket 10 can be formed from wire or molded from plastic. The formed wire version is depicted in the drawings. The product display bracket 10 includes a mounting member 12 at the rear of the product display bracket 10. The mounting member 12 in the drawings is in a configuration that is adapted to be clipped onto a conventional wire grid display panel (not shown). One skilled in the art will recognize that other conventional configurations of mounting members 12 will be adapted for support from peg board display walls and slat wall display board. The peg board display board is formed with a plurality of spaced apart holes that permit a great deal of flexibility in the positioning of the mounting member, and thus the product display bracket 10, both vertically and horizontally on the display board (not shown). The slat wall display board (not shown) is formed with vertically spaced, horizontally extending grooves (not shown) into which the appropriately configured mounting member is supported. The wire grid display board is formed with a plurality of vertically spaced, horizontally disposed wires (not shown) instead of grooves. The top loop 13 of the mounting member is hooked over a selected wire (not shown) while the wire immediately below the selected wire is snapped into position above the lower loop 14. The spacing between the two wires is slightly greater than the corresponding spacing between the underside of the top loop 13 and the top of the lower loop 14 so that the mounting of the mounting member 12 on the selected wires (not shown) creates tension in the wires to fix the mounting member 12 on the wire grid display board.

Figure 2:
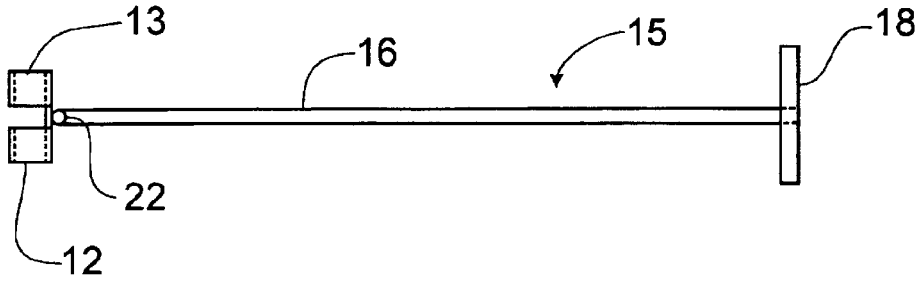
FIG. 2 is a top plan view of the product identification member forming the top portion of the product display bracket depicted in FIG. 1.
Figure 8:
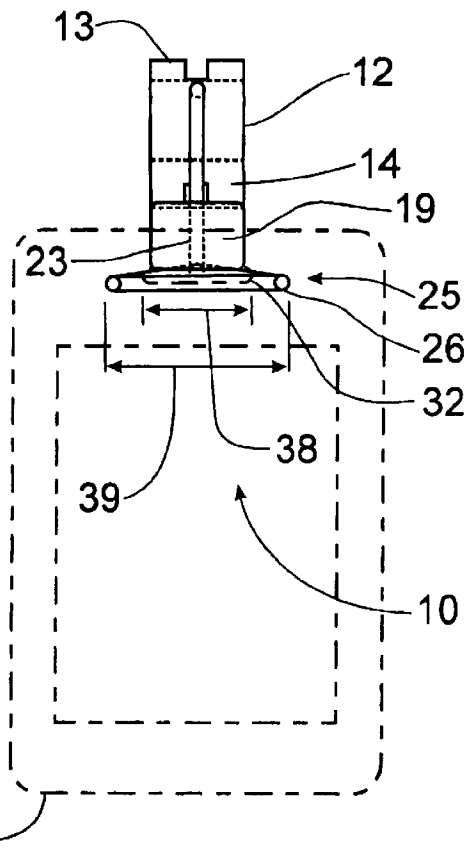
FIG. 8 is a front elevational view of the product display bracket shown in FIG. 7 with the front product package being depicted in phantom against the head portion of the support member.
Figure 7:
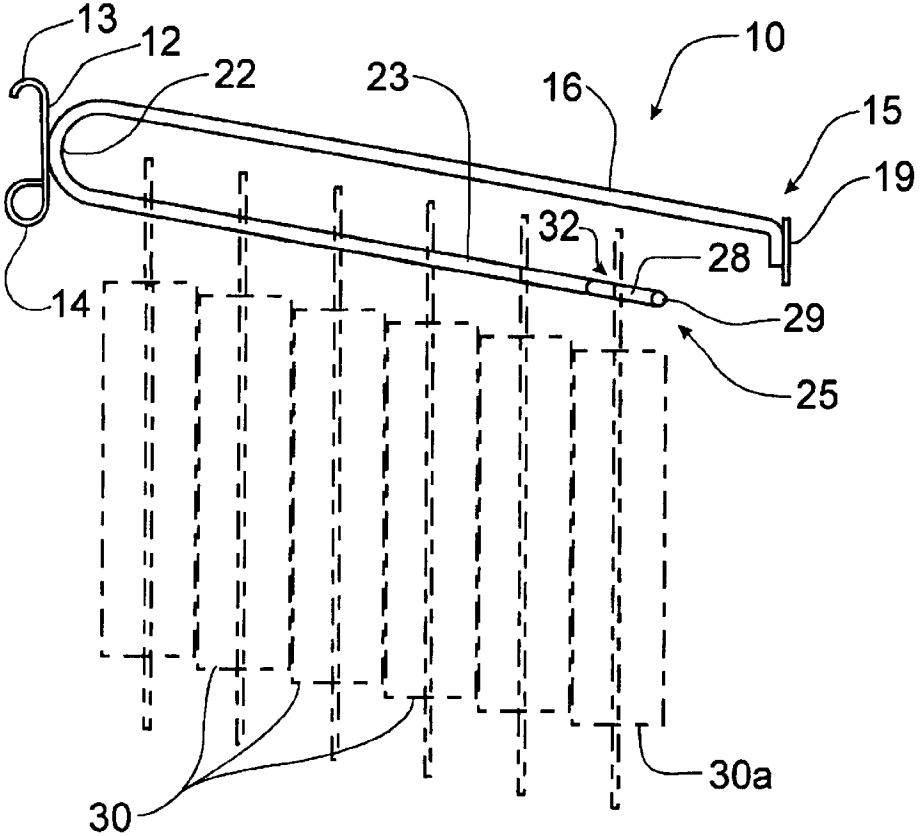
FIG. 7 is a side elevational view of a third embodiment of the product display bracket with the support member and the product identification member angled downwardly at approximately ten degrees relative to the horizontal configuration depicted in FIG. 1, representative product packages being depicted in phantom.

The product display bracket 10 can be formed with an optional product information display member 15 that includes a linearly extending support rod 16 terminating in a label mount 17, which can be configured into several alternative versions, including the transverse clip rod 18, depicted in FIGS. 1 and 2; a label holder 19, as depicted in FIGS. 7 and 8; or a flip member (not shown). One skilled in the art will recognize that at least one configuration of a flip member can be mounted on the transverse rod 18 to permit an upward pivoting of the flip member about a pivot axis defined by the transverse rod 18. In the formed wire version of the product display bracket 10, as depicted in FIGS. 1-8, the product information display member 15 is preferably formed integrally with the product support member 20, as is described in greater detail below. The purpose of the product information display member is to provide product information such as type of product, price, or a bar code.

Figure 3:
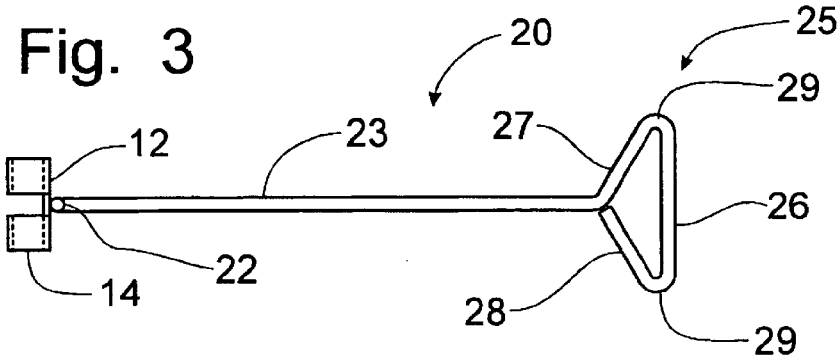
FIG. 3 is a bottom plan view of the support member forming the lower portion of the product display bracket depicted in FIG. 1.

The product support member 20 includes a linear portion 23 that extends parallel to the support rod 16 and is positioned beneath the support rod 16. Preferably, the support rod 16 and the product support member 20 are formed from a single piece of wire with a curved loop portion 22 interconnecting the two linearly extending product support member 20 and support rod 16. The distal end of the product support member 20 is formed into a head portion 25 that preferably lies in a generally horizontal plane in which the product support member 20 lies. The head portion 25 is best seen in FIGS. 1, 3 and 6 and is preferably formed in a triangular shape with the hypotenuse 26 of the triangular shape being oriented perpendicularly to the linear portion 23. The respective sides 27, 28 of the triangular shape extend rearwardly from the hypotenuse 26 at an acute angle relative to the hypotenuse 26, preferably in the range of thirty degrees, to the linear portion 23.

As best seen in FIGS. 7 and 8, a blister pack product package 30 is typically provided with a slotted opening 32 at an upper part thereof. This opening 32 has a transverse dimension 38 that is normally 1 and 3/16 inches wide and high enough to accommodate the passage of a formed wire product display bracket, which is typically 0.148 inches in diameter. The sides 27, 28 of the triangularly-shaped head portion 25 are sized at 1 and 3/16 inches to permit the passage of the slotted opening 32 around the apex 29 at the juncture of one of the sides 27, 28 and the hypotenuse 26. With the angular relationship between the sides 27, 28 and the hypotenuse 26 of the triangular shape being in the range of thirty degrees, the hypotenuse 26 has a resultant transverse dimension 39 that is 1 and 31/32 inches wide. With the width dimension 39 of the hypotenuse 26 of the head portion 25 being substantially wider than the corresponding width dimension 38 of the slotted opening 32 in the product packaging 30, the product packaging 30 cannot be pulled straight off the product support member 20 without being manipulated around one apex 29 and then the other apex 29.

Alternative embodiments of the product display bracket 10 can be found with reference to FIGS. 5 and 7-8. In FIG. 5, the curved loop portion 22 interconnecting the product support member 20 and the support rod 16 is welded to the mounting member 12 in a manner that the linear portion 23 of the product support member 20 is inclined upwardly at an acute angle to horizontal, preferably in the range of ten degrees. This particular orientation of the product support member 20 enhances the access to any product packages mounted on product display brackets (not shown) that would be located below or a shelf (not shown) that would be positioned below the particular product display bracket 10.

In the alternative embodiment depicted in FIGS. 7 and 8, the curved loop portion 22 is welded to the mounting member 12 in such a manner as to angle the linear portion 23 of the product support member 20 downwardly at an acute angle, preferably in the range of ten degrees. This particular orientation of the product support member 20 allows the automatic feeding of product packages 30 to the head portion 25 so as to be presented to the potential consumer. Since the hypotenuse 26 is wider than the typical slotted opening 32 in the product package 30, the product package 30 cannot slide off the product support member 20, as it will be halted by the head portion 25. After removal of the front product package 30a in the manner described above, the remaining product packages 30 will slide down the linear portion 23 of the product support member 20 until stopped by the enlarged head portion 25.

One skilled in the art will recognize that other shapes and configurations of the head portion 25, other than the preferred triangularly-shaped head portion 25 can provide an effective deterrent to the removal of multiple product packages 30 simultaneously from the product support member 20. A T-shaped configuration, for example, where the full width of the head portion is wider than the typical slotted opening 32 is also capable of requiring singular removal of the product packages 30 from the product support member 20. The triangular configuration as depicted in the drawings, however, is preferred as the rearwardly sloping sides 27, 28 operate to substantially center the product package 30 on the head portion 25 when the product support member 20 is angled downwardly as is depicted in FIGS. 7 and 8.

In use, the product display bracket 10 formed with an enlarged head portion 25 limits the removal of product packages one at a time from the product support member 20, due partially to the thickness of the packages 30 and primarily to the requirement that the package must be moved to one side 27 of the head portion 25 to be cleared of the apex 29 before being able to be moved along the opposing side 28 to clear the other apex 29. In restricting the removal of packages 30 in a singular manner, the product on display is not subject to being grasped in multiples and, thus, shoplifting risks are minimized. Furthermore, the provision of an enlarged head portion 25 that prevents the product packages 30 from sliding off the product support member 20, enables the product support member 20 to be angled downwardly to allow remaining product packages 30 to slide to the head portion 25 after the front package 30*a* has been removed.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A product display bracket for supporting a product package having a slotted opening therein defining a first width dimension, comprising:

a mounting member adapted for connection with a product display board; and a product support member affixed to said mounting member and including:

a linear portion affixed to said mounting member and projecting outwardly therefrom; and a rigid, non-deformable head portion at the forward distal end of said linear portion and having opposing transversely spaced ends defining a transverse width dimension adapted to be greater than said first width dimension of said slotted opening in said product package, said head portion being formed such that a distance from said linear portion to either of said transverse ends of said head portion is adapted to be less than or approximately equal to said first width dimension, thus requiring said product package to be removed from said product support member by being moved to one side of said head portion;

wherein said head portion is formed with a pair of sides that form an apex at each transversely opposing end of said head portion and extend rearwardly towards said mounting member from each respective said apex to converge at said linear portion.

2. The product display bracket of claim 1 wherein said head portion is formed in a triangular shape with a hypotenuse member oriented generally perpendicularly to said linear portion of said product support member.

3. The product display bracket of claim 2 wherein said product support member is affixed to said mounting member in a manner to be angled downwardly when said mounting member is mounted on said product display board.

4. The product display bracket of claim 2 wherein each said side has a length adapted to be equal to said distance.

5. The product display bracket of claim 4 wherein said length is adapted to be substantially equal to said first width dimension of said slotted opening in said product package.

6. The product display bracket of claim 5 wherein said sides form an acute angle with said hypotenuse at each respective said apex.

7. The product display bracket of claim 6 wherein said acute angle is in the range of 15 to 45 degrees.

8. The product display bracket of claim 2 further comprising a product information member affixed to said mounting member and projecting forwardly thereof above said product support member.

9. The product display bracket of claim 8 wherein said product information member includes a linear support rod that is oriented generally parallel to said linear portion of said product support member, said support rod and said linear portion of said support member being integrally formed and affixed to said mounting member.

10. A product display bracket for supporting a product package having a slotted opening therein defining a first width dimension, comprising:

a mounting member adapted for connection with a product display board; and a product support member including:

a linear portion affixed to said mounting member and projecting forwardly therefrom, said linear portion being oriented with respect to said mounting member to be angled downwardly when said mounting member is mounted on said product display board such that said product packages are urged by gravity to move forwardly on said linear portion; and a head portion formed at a forward distal end of said linear portion and defining a transverse width dimension adapted to be greater than said first width dimension of said slotted opening in said product package, thus preventing said product packages from sliding off the end of said downwardly oriented linear portion, said head portion being formed in a triangular shape with a hypotenuse member oriented generally perpendicularly to said linear portion of said product support member and a pair of sides that form an apex at each transversely opposing end of said head portion and extend rearwardly towards said mounting member from each respective said apex to converge at said linear portion.

11. The product display bracket of claim 10 wherein said head portion has opposing transversely spaced ends defining a transverse width dimension that is adapted to be greater than said first width dimension of said slotted opening in said product package, said head portion being formed such that a distance from said linear portion to either of said transverse ends of said head portion is adapted to be less than or approximately equal to said first width dimension, thus permitting said product package to be removed from said product support member by being moved to one side of said head portion.

12. The product display bracket of claim 10 wherein each said side forms an acute angle with said hypotenuse at each respective said apex, each said side having a length dimension adapted to be substantially equal to said first width dimension of said slotted opening in said product package.

13. The product display bracket of claim 12 further comprising a product information member including a linear support rod that is oriented generally parallel to said linear portion of said product support member, said support rod and said linear portion of said support member being integrally formed and affixed to said mounting member.

14. A method of displaying product packages in a store, said product packages having a slotted opening therein, comprising the steps of:

placing said product packages on a product display bracket having a product support member extending forwardly from a mounting member connected to a display board for supporting a plurality of said product packages;

providing a rigid, non-deformable head portion on said product display bracket, said head portion having a transverse width dimension greater than a corresponding transverse width of said slotted opening, said head portion being substantially centered on said product support member and having sides that extend rearwardly towards the mounting member from respective apexes and converge at said product support member; and removing one product package from said product display bracket without manipulating said product display bracket by sliding said product package to one side of said head portion such that said slotted opening extends from said product support member around an end of said head portion and then sliding said product package laterally along said head portion to clear said slotted opening around an opposing end of said head portion.

15. The method of claim 14 further comprising the step of:

angling said product display bracket so that said product support member is angled downwardly relative to horizontal so that product packages supported on said product support member slide toward said head portion when a front product package is removed during said removing step.

16. The method of claim 15 wherein said angling step includes the step of providing said product support member affixed to said mounting member at an angle that orients said product support member downwardly relative to a horizontal orientation when said mounting member is connected to said product display board.

17. The method of claim 16 wherein providing step provides a head portion formed in a triangular configuration with a hypotenuse oriented perpendicularly to said product support member, said head portion providing the step of:

centering said front product package on said head portion.

18. The method of claim 17 further comprising the step of:

displaying information about said product packages on a product information display member positioned above said product support member and oriented generally parallel thereto.

* * * * *